US007035170B2

(12) United States Patent
Narayanaswami et al.

(10) Patent No.: US 7,035,170 B2
(45) Date of Patent: Apr. 25, 2006

(54) DEVICE FOR DISPLAYING VARIABLE DATA FOR SMALL SCREENS

(75) Inventors: Chandrasekhar Narayanaswami, Wilton, CT (US); Mandayam Thondanur Raghunath, Fishkill, NY (US)

(73) Assignee: International Business Machines Corporation, Armonk, NY (US)

( * ) Notice: Subject to any disclaimer, the term of this patent is extended or adjusted under 35 U.S.C. 154(b) by 266 days.

(21) Appl. No.: 10/425,585

(22) Filed: Apr. 29, 2003

(65) Prior Publication Data

US 2004/0218472 A1 Nov. 4, 2004

(51) Int. Cl.

| | |
|---|---|
| ***G04B 19/00*** | (2006.01) |
| ***G04B 25/00*** | (2006.01) |
| ***G04B 47/00*** | (2006.01) |
| ***G04L 17/00*** | (2006.01) |

(52) U.S. Cl. ..... 368/223; 368/10; 368/239

(58) Field of Classification Search ..... 368/10; 340/825.26, 825.27; 116/284, 298, 303; 705/35, 36 R, 37, 34; 345/440, 440.1, 23, 345/27

See application file for complete search history.

(56) References Cited

U.S. PATENT DOCUMENTS

| | | | | |
|---|---|---|---|---|
| 2,005,807 A * | 6/1935 | Smith | 377/13 |
| 3,877,410 A * | 4/1975 | Biven | 116/31 |
| 4,995,015 A * | 2/1991 | Chiang | 368/11 |
| 5,339,392 A * | 8/1994 | Risberg et al. | 715/762 |
| 5,583,830 A * | 12/1996 | Okuyama | 368/11 |
| 6,191,799 B1 * | 2/2001 | Purdy | 345/473 |
| 6,639,614 B1 * | 10/2003 | Kosslyn et al. | 715/837 |
| 6,927,772 B1 * | 8/2005 | Page | 345/440 |

* cited by examiner

*Primary Examiner*—Andrew H. Hirshfeld
*Assistant Examiner*—Leo T. Hinze

(74) *Attorney, Agent, or Firm*—Michael J. Buchenhorner, Esq.; Casey P. August

(57) ABSTRACT

A device and method for displaying variable data comprises: logic for displaying a gauge that comprises a closed two-dimensional shape. The two-dimensional shape comprises a linear pointer inside the shape, the location of the pointer being determined as a function of a change in an item of data during a predetermined time interval. A device and method for displaying variable data comprises: logic for displaying an annular graph representing changes in a quantifiable item of data during a predetermined time interval, wherein the annular graph is positioned around a clock face. A computer program product comprises instructions for: displaying a graphical representation of variable data comprising displaying a gauge; and also for: displaying an annular graph representing changes in a quantifiable item of data during a predetermined time interval, wherein the annular graph is positioned around a clock face.

4 Claims, 6 Drawing Sheets

DEVICE FOR DISPLAYING VARIABLE DATA FOR SMALL SCREENS

CROSS-REFERENCE TO RELATED APPLICATIONS

Not applicable.

STATEMENT REGARDING FEDERALLY SPONSORED RESEARCH OR DEVELOPMENT

None.

INCORPORATION BY REFERENCE OF MATERIAL SUBMITTED ON A COMPACT DISC

None.

FIELD OF THE INVENTION

The invention disclosed broadly relates to the field of small electronic devices and more particularly relates to the field of image displays on small electronic devices.

BACKGROUND OF THE INVENTION

Advances in wireless technology and the proliferation of portable electronic devices have sparked an increasing demand for anytime, anywhere connectivity. Consumers today have come to expect immediate access to news and financial data, regardless of where they are. Many people, whether or not they are actively trading stock, wish to follow the movement of stock and/or commodity prices. News broadcasts on television often feature an electronic ticker tape at the bottom of the screen. Many popular websites and electronic-financial companies, such as E*Trade, display stock price movement in real time because there is a strong demand for this information. For this reason certain small portable electronic devices, such as portable digital assistants and wristwatches are utilized for tracking stock movement. These devices can display stock prices and denote price fluctuations in a very compact form factor. Price fluctuations are commonly represented as up or down arrows. The drawback with these small devices, and wristwatches in particular, is that the viewable display area is so small that it is difficult to discern the direction of the arrows. Additionally, someone who is keenly interested in a stock's price movement would also need to know the magnitude of the change in addition to the direction of the change. This information, displayed in text format, would be too difficult to read on a watch face because of its small size.

FIG. 1 shows a portable display device 100 worn as a wristwatch. The display area 101 represents the typical dimensions of a display area on a wrist watch. As can be clearly seen, the display area is quite small, typically about 16.5 mm by 22 mm. While this size is adequate for displaying a clock face, it presents a problem when more information and a combination of text and graphics needs to be conveyed in the same small space. Additionally, the increasing popularity of "smart watches" has created a need for data entry and selection capabilities for wrist watches. This need has been addressed in commonly-owned U.S. Pat. No. 6,525,997 B 1 "EFFICIENT USE OF DISPLAY REAL ESTATE IN A WRIST WATCH DISPLAY" incorporated by reference as if fully set forth herein. A rotating wheel, or "jog encoder" 105 allows a user to scroll over and select options by rotating and depressing the wheel, respectively. The display area 101 can also be a touch-sensitive high resolution display screen which displays not only the time, but can also present icons to be selected by a user by depressing the zone on the screen where the icon is located.

In addition to stock prices, there are other types of variable data which an individual might wish to keep track of, such as location/compass indicators from a Global Positional System (GPS), ambient temperature and barometric pressure. The problem is that any meaningful data concerning changes in these values are difficult to view on very small displays, using current technology. Therefore there is a need for a device which overcomes the shortcomings of the prior art.

SUMMARY OF THE INVENTION

Briefly, according to a claimed invention, a device for displaying variable data comprises: logic for displaying a gauge that comprises a closed two-dimensional shape. The two-dimensional shape comprises a linear pointer inside the shape, the location of the pointer being determined as a function of a change in an item of data during a predetermined time interval. According to another claimed invention, a device and method for displaying variable data comprises: logic for displaying an annular graph representing changes in a quantifiable item of data during a predetermined time interval, wherein the annular graph is positioned around a clock face. A computer program product comprises instructions for: displaying a graphical representation of variable data comprising displaying a gauge; and also for: displaying an annular graph representing changes in a quantifiable item of data during a predetermined time interval, wherein the annular graph is positioned around a clock face.

DESCRIPTION OF THE PREFERRED EMBODIMENTS

We describe a lightweight, wireless, portable device for displaying variable data and the changes in variable data in both text and graphical format. The device features a display similar in appearance and size to a watch face, with a high-resolution monochrome image for displaying text and graphical images. In the examples to follow the text and graphical images represent variable data in the form of stock prices, but other types of variable data could be represented within the spirit and scope of the invention. The wireless portable device receives data via signals transmitted through low-power short-range transmissions, such as infra-red (IR) or radio frequency (RF) signals; or optionally, through other short-range transmission methods such as Bluetooth™ Wireless.

Figure 1:
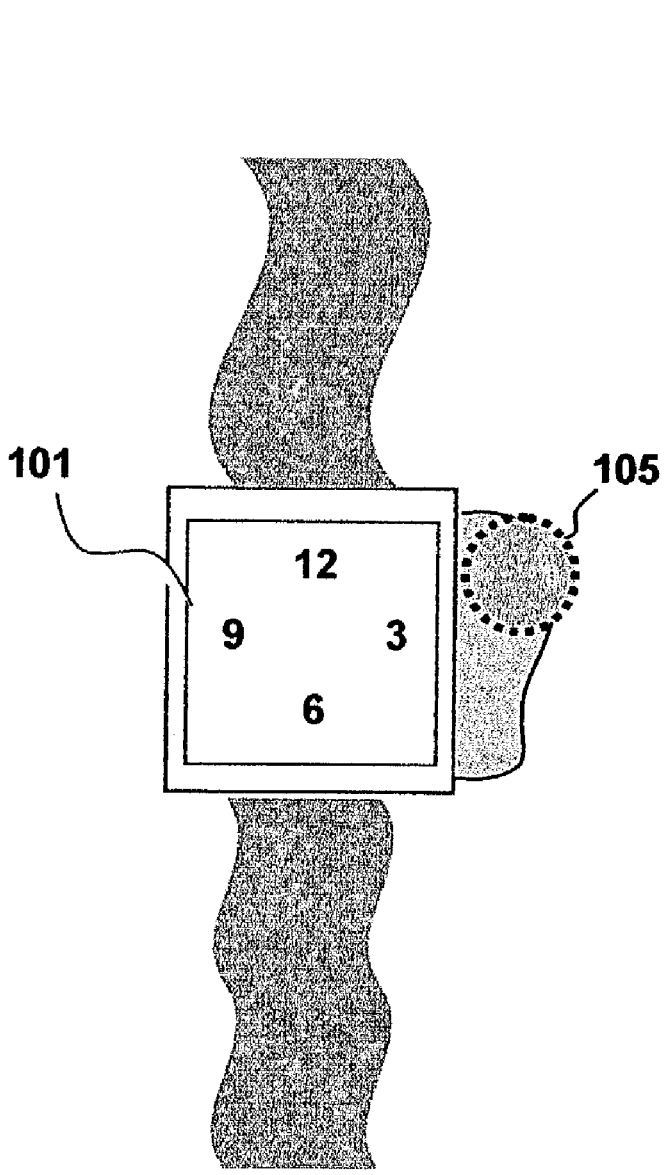
FIG. 1 Prior Art
FIG. 1 is an illustration of a portable display device, according to the prior art.
Figure 2:
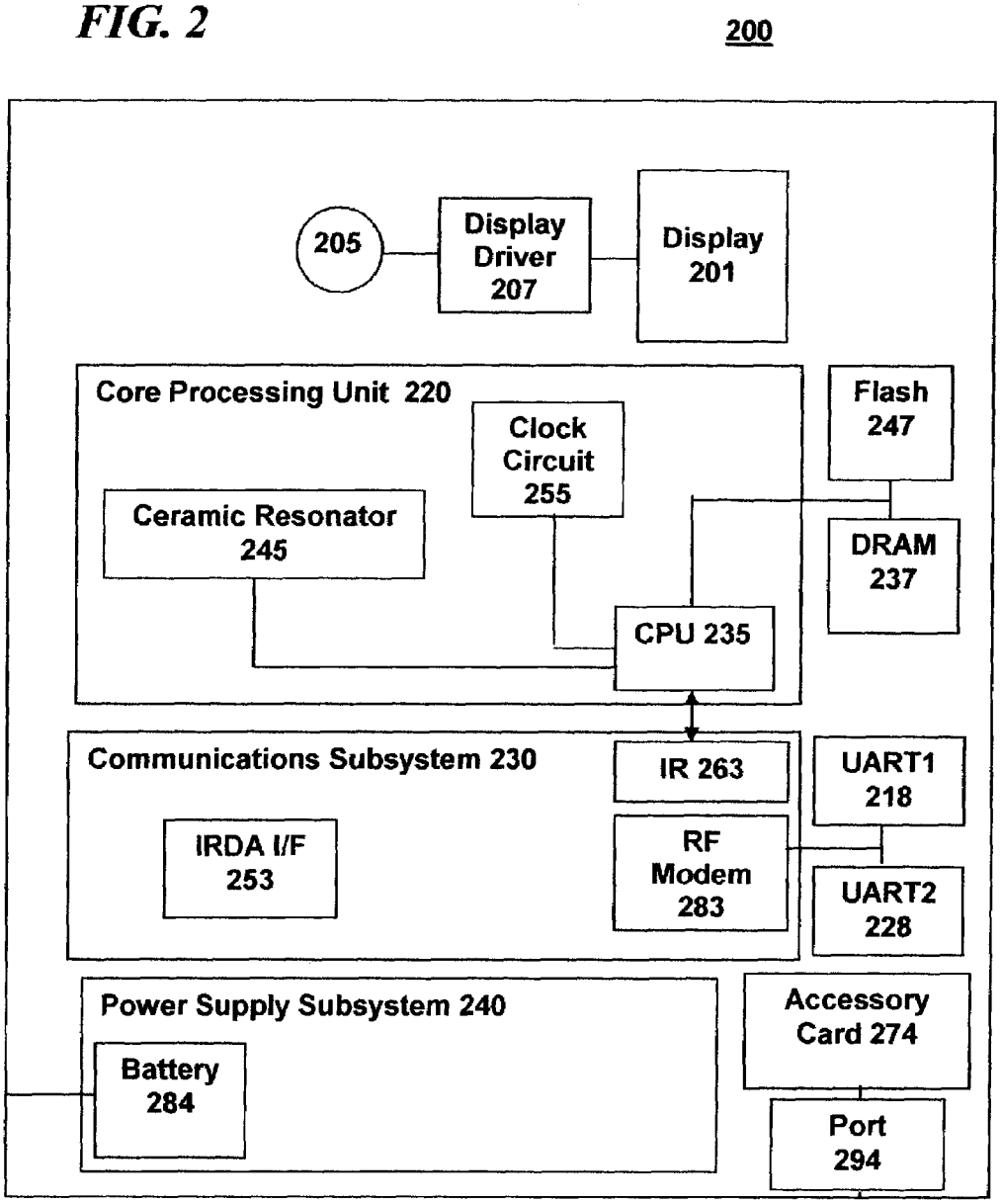
FIG. 2 is a simplified block diagram of a portable device according to an embodiment of the invention.

Referring to FIG. 2, there is shown a simplified block diagram of a portable device 200 according to an embodiment of the invention. The portable device 200 is preferably the size and weight of a wristwatch, wherein a display 201 of the portable device 200 is similar in appearance and size to a watch face and can be implemented in a circular or an elliptical format, as described in commonly-owned U.S. Pat. No. 6,525,997 B1 "EFFICIENT USE OF DISPLAY REAL ESTATE IN A WRIST WATCH DISPLAY" which is incorporated by reference as if fully set forth herein. A roller wheel 205 is attached to the display 201 and both the display 201 and the roller wheel 205 are controlled by a display driver 207. The roller wheel 205 functions much like a mouse apparatus connected to a personal computer (PC).

The display 201 displays data in text and graphical format and is preferably a high resolution emissive Organic Light Emitting Diode (OLED) high contrast display. The display 201 also embodies a touch-sensitive screen to facilitate data selection. A Core Processing Unit 220 contains a CPU 235, such as a Cirrus Logic CL-EP7211 which is a single-chip embedded controller for ultra low-power applications. The CPU 235 employs a first Universal Asynchronous Receiver Transmitter (UART) device 218 for supporting either the radio frequency (RF) modem 283 or Bluetooth™ communications functionality and may be equipped with a second UART device, UART2 228 providing support for data download functionality, perhaps from a personal computer (PC), personal digital assistant (PDA) or a network server.

The Core Processing Unit 220 may optionally contain a 3.68 MHz Ceramic Resonator 245 for generating the clock and timing signals, and a crystal-based clock circuit 255 for use in tracking real time. In addition the device 200 includes nonvolatile and volatile memory, including, for example, a 64 Mbit EDO DRAM 237 and a SRAM/Flash Memory 247, along with a Display Driver 207 for controlling the display. A Communications Subsystem 230 of the device 200 includes a line of sight Infrared Data Association (IRDA) communications interface 253 having a low-power IR transceiver module 263 for direct connection with the CPU 235. Optionally, the device 200 may include various Analog to Digital converters, memory refresh logic and industry standard interfaces such as a compact flash interface so that other devices can be attached to the device 200 through the port 294.

The device 200 also contains a Power Supply Subsystem 240 including a rechargeable lithium-polymer type battery 284. An Accessory Card 274 is equipped with various communications subsystems including low power and intermediary power RF communications devices that support a Wireless Application Protocol (WAP) used to provide communications links to mobile computers, mobile phones, portable handheld devices and connectivity to the internet. In one embodiment of the invention, the Communications Subsystem 230 includes circuitry for supporting Bluetooth™ Wireless, however it should be understood that other standards such as IEEE 802.11 or other RF protocols may be implemented as well.

In another embodiment of the invention, the communication protocols may be implemented directly in the Core Processing Unit 220 so that the total number of required components is minimized. This is an important consideration when dealing with devices of such a small size.

Figure 3:
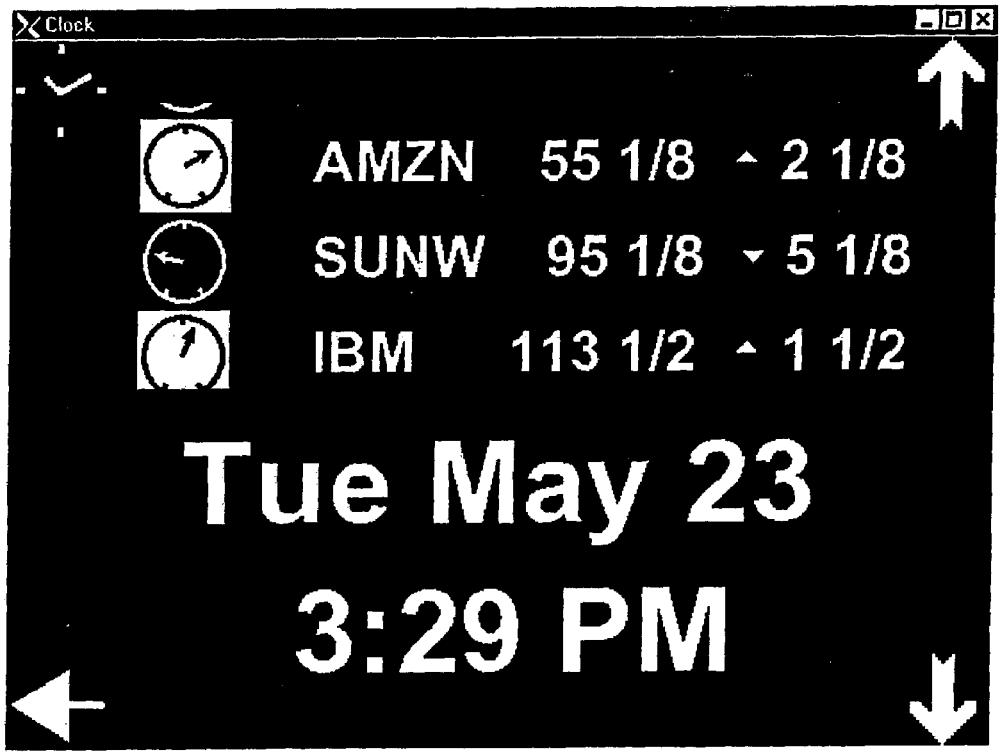
FIG. 3 is an illustration of a small monochrome display showing stock price changes, according to an embodiment of the invention.

Referring to FIG. 3 there is shown a close-up image 300 of the display 201 of one embodiment of the invention wherein stock price changes are displayed on a watch face. Although the device 200 is enabled to display other types of variable data, such as temperature and barometric pressure, we will focus our examples on stock prices and stock price fluctuations. FIG. 3 shows a monochrome display in white font on a black background. The image 300 shows how a selection of stock prices can be displayed, along with changes in stock price, in a very small area. The stock ticker symbols are clearly displayed in text format, along with the current stock price. To the right of the stock price is shown a graphical symbol "▲ or ▼" to represent the up or down movement of the stock price, along with the actual price change. Looking at this image 300 we see that Amazon.com, with the ticker symbol of "AMZN" is currently trading at approximately $55.13 which is a $2.13 increase from its last posting. The high-resolution makes this monochromatic display very easy to read.

To the left of the ticker symbols are shown gauges representing stock price movement. These gauges are illustrated as small circles with arrows in the center and three notches designating 12 o'clock, 5 o'clock and 7 o'clock, but other shapes could be contemplated within the spirit of the invention. The gauges show stock price movement in two different ways. First of all, the gauges show price movement with color. If the price decreases or stays the same, the gauge is shown in reverse video. Referring to image 300 we see that the gauge associated with Sun Microsystems, Inc. (ticker symbol SUNW) is in reverse video (white on black in this case), so we can quickly tell, at a glance, that this stock price is down.

Secondly, price movement is also shown on the gauges through the positioning of the arrows. If the stock price has not changed since the previous posting the arrow will be at the 12 o'clock position. If the stock price change is positive the arrow moves towards the 5 o'clock position. The degree of the angle (from 12 o'clock) depends on the magnitude of the change. If the stock is 25% or more above the previous close the arrow sticks at the 5 o'clock position. If the magnitude of the increase is smaller the arrow is positioned somewhere between the 12 o'clock position and the 5 o'clock position with the angular position indicating the amount of change. If the stock price change is negative the arrow moves towards the 7 o'clock position counter-clockwise from the 12 o'clock position. If the stock is down ten percent the arrow will be at the 10 o'clock position. If the stock price is down 25% or more the arrow will be at the 7 o'clock position.

In one embodiment, the stock prices will be displayed a few at a time (three in this example) as part of a stock ticker and those prices will remain visible on the display screen 201 for a predetermined amount of time before the stock ticker scrolls forward or backward to display a greater selection of stocks, similar to a ticker tape. In a preferred embodiment, as shown in image 300 the stock ticker scrolls vertically to allow more than one stock to show on a display screen. In another embodiment the stock ticker scrolls horizontally, displaying information for one stock at a time. In a horizontal stock ticker the font size could be increased, so that it would be easier to read, but since only one stock is shown at a time, scrolling through the list of stocks will take longer.

In addition to the stock information, the image 300 displays the current date and time at the bottom of the screen. This is a very desirable feature because the preferred implementation of this invention is a wristwatch. The screen is preferably a touch screen, with four distinguishable zones, one for each quadrant, as described in "Application Design for a Smart Watch with a High Resolution Display" by Chandra Narayanaswami and M. T. Raghunath. Each zone is represented by an icon. A user selects a function by depressing any area of the quadrant where the icon representing the desired function appears. In this example, the icon in the upper left-hand corner is a clock. Tapping the quadrant where this icon is located will return the screen image to a clock (this is analogous to a "Home" page on a web site). The upper right-hand corner shows an "up" arrow for scrolling the ticker forward. The lower right-hand corner shows a "down" arrow for backward scrolling, and the lower left-hand corner shows a "back" arrow for returning to the previous screen. It should be noted that these icons are specific to this example and that other icons, as well as other functions, could be used in keeping with the spirit and scope of the invention.

An alternate method for function selection is to rotate the roller wheel 205 until the desired icon is highlighted, then click (or press down on) the wheel 205. Rolling the wheel 205 causes a scrolling action and clicking the wheel 205 causes a selection action similar to a mouse click. Setting the time could be done in this manner, as well. Rolling the wheel 205 moves the hands of the clock and clicking the wheel 205 sets the time.

Figure 4:
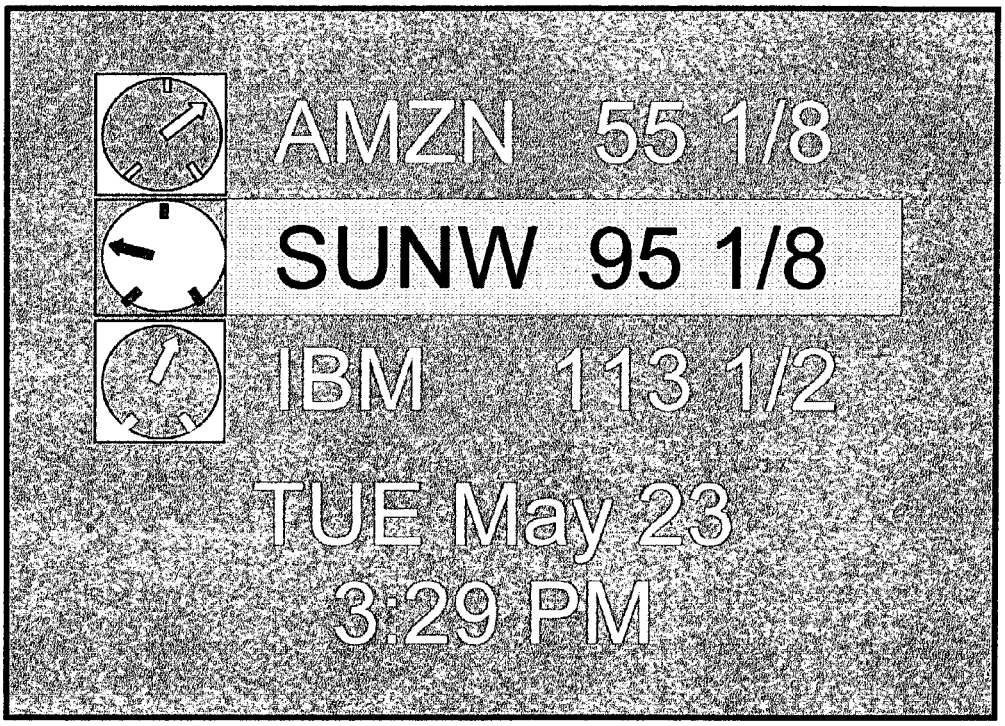
FIG. 4 is an illustration of a small monochrome display showing stock price changes, according to an embodiment of the invention.

Referring to FIG. 4 there is shown another embodiment wherein the disclosed invention can be advantageously used. The image 400 shows the vertical stock ticker of FIG. 3. However, in this example the directional symbols "▲ or ▼" and the amount of the price change are not displayed, thus freeing some space on the display ("display real estate"). The additional space is used to increase the size of the font. The gauges inform the user of the direction of the stock price change and the relative amount of the change.

Figure 5:
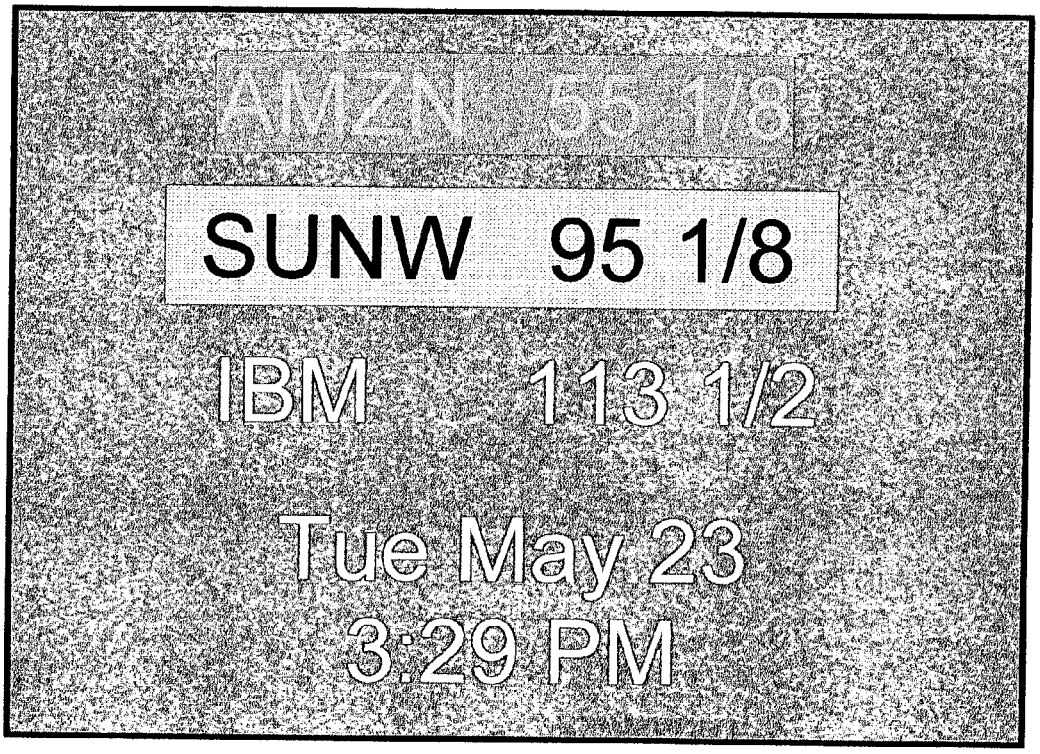
FIG. 5 is an illustration of a small monochrome display showing stock price changes, according to another embodiment of the invention.

Referring to FIG. 5 there is shown an image 500 representing another embodiment for the display 201. In this image 500 the vertical stock ticker is shown displaying the name of the stock and the current price of the stock. The gauges are not displayed in this image 500. Instead, the ticker symbol itself is shown in reverse video if the stock price has decreased since the last posting. In this example a user would be able to tell if a stock price has gone up or down by glancing at the stock symbol. A stock whose price has increased would be represented in the normal display mode. A stock whose price is falling would be shown in reverse video. An unchanged stock price could be shown in normal display mode, or in a third color, such as gray. However, since the current display technology for wristwatches does not support color or gray-scale, a third color (to represent an unchanged stock price) would have to be simulated. One way to do this is to employ spatial dithering, as used in newspaper photos. For example, in FIG. 5 assume that the stock price for Amazon.com remains unchanged. In this example you will notice that the text for AMZN appears as gray, not black or white, as a result of dithering.

A stock ticker details the current price of a stock and the price change only. There are circumstances wherein a person would need to know the price movements of a stock during the course of a day. Many investors like to track these price movements, perhaps to record trends.

Figure 6:
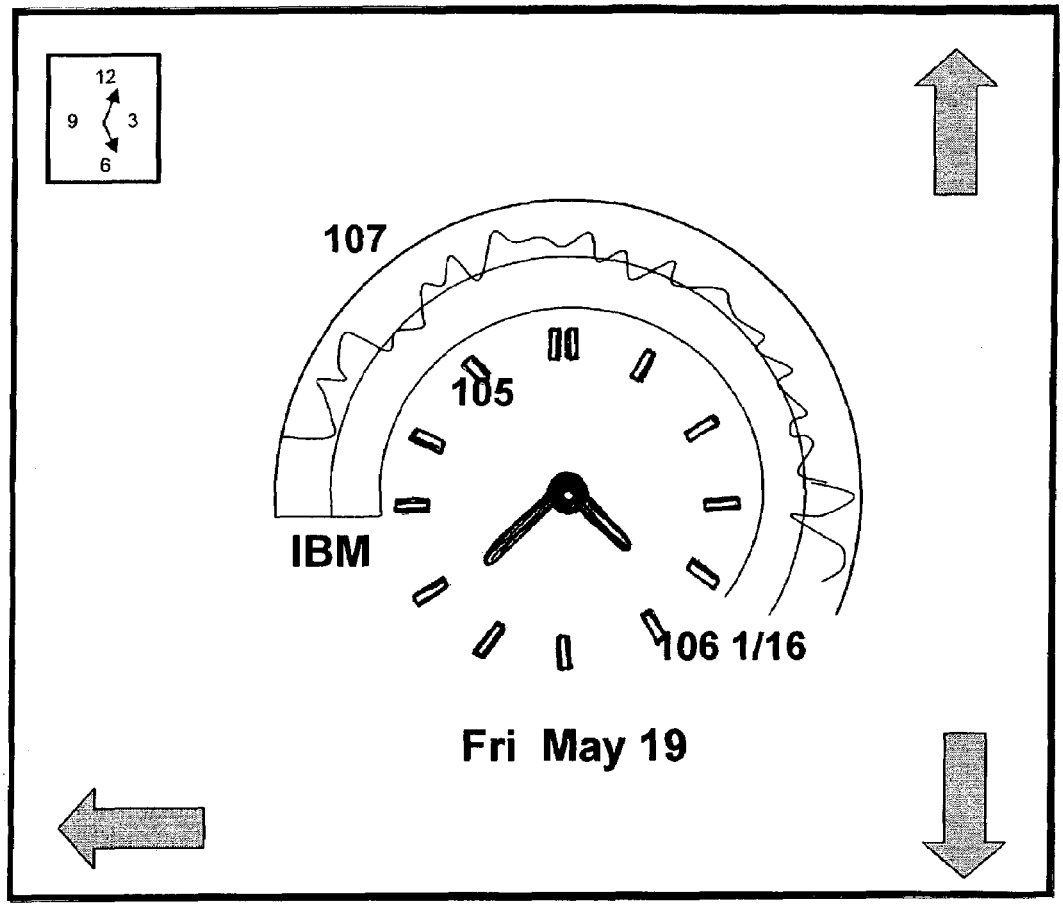
FIG. 6 is an illustration of a small monochrome display showing stock price quotes, according to an embodiment of the invention.

FIG. 6 shows an example of a display showing stock price movements over the course of a trading day. The display of FIG. 6 also combines text and graphics to show stock prices and stock price movements, but in this example the movements are shown graphically on an annular graph around a circular clock face. Displaying a graph encompassing a circular clock face clearly shows stock price movement during the course of a trading day. The graph begins at the 9:00 o'clock position and ends at the 4:30 o'clock position on the clock face, which represents a trading day.

The horizontal axis of the graph corresponds to the time of day during a stock trading day. The vertical axis corresponds to the stock price. The graph has three curved lines corresponding to the horizontal lines on a linear graph. The three curved lines represent the low, midpoint and high trading price of the stock throughout the day. The bottom line represents the lowest traded price of the day for that stock and the top line represents the peak price for that trading day. The center line is the midpoint between the two prices. Since the low, midpoint and peak trading prices are not known when the graph first appears, these lines are merely placeholders, and do not represent points at exactly the same amount or distance from each other, as in conventional graphs. In FIG. 6 the stock ticker symbol ("IBM" in this example) is displayed underneath the graph. In other embodiments either the stock ticker symbol or name of the company could be shown in other areas on the display in close proximity to the graph so that an association between the graph and the company is obvious to a viewer.

The graph can be continuously updated with the stock price information during the course of a trading day. This stock price data can be received via short-range or medium-range signals from a user's PC, PDA or from a network server, as previously discussed. In a preferred embodiment, the opening trading price is shown in close proximity to the 9:00 o'clock position so that it is clear that this price represents the opening price. The lowest trading price is shown underneath the bottom line and the highest trading price is shown above the top line. At the close of the trading day, which falls at the 4:30 p.m. mark, the closing price of the stock is displayed in close proximity to the 4:30 p.m. mark so that it is clear that the price shown is the price at which the stock closed.

Multiple stock prices can be displayed on a rotating basis, similar to a slide presentation. An automatic rotation time could be set for the stock display. A user can select a group of stocks to watch, perhaps downloading a list from a PC or PDA, and view the stock information on a watch face as though viewing a slide presentation. For example, data for one stock can be set to be visible on the screen for five seconds before it is replaced by another stock on the display. To set the automatic rotation time in this embodiment, the watch could present an icon for rotation time and the user could select this icon, either by tapping on the icon's quadrant, or using the roller wheel 205. Once the rotation icon is selected, then a rotation time could be selected by selecting from a pre-set menu of times, or by clicking the roller wheel 205 multiple times to represent seconds. The stock displays can also be rotated manually by depressing the arrows on the bottom corners of the display. Depressing the "←" on the bottom left-hand side of the display would display the previous stock in the rotation and depressing the "→" on the bottom right-hand side of the display would display the next stock in the rotation.

Other variable data values could also be represented as an annular graph around a clock face. For example, ambient temperature readings could be recorded and graphed throughout the day, for any chosen twelve-hour period. The graph can be refreshed with new readings after a twelve-hour period. A myriad of uses can be contemplated for the annular graph. Some possible uses in the medical arena are tracking heart-rate, blood pressure, or insulin levels during the course of a day, or during the course of an observation period. In the area of commerce, inventory levels and sales can be tracked and compared with the same data at other retail sites.

Because the wrist watch display does not have a keyboard, most textual content will be created on another device, such as a PC, and then transferred to the watch. Wireless Markup Language (WML) is the preferred text format for textual representation on the watch display.

Therefore, while there has been described what are presently considered to be the preferred embodiments, it will be understood by those skilled in the art that other modifications can be made within the spirit of the invention.

We claim:

1. A device for displaying variable data, the device comprising: an input for receiving at least one item of data; an electronic display; and logic for displaying an annular graph representing changes in a quantifiable item of data during a predetermined time interval, wherein the annular graph is positioned around a clock face.

2. The device of claim 1 wherein a starting point of the annular graph is positioned at the 9 o'clock position on the watch face and the ending point of the annular graph is positioned at the 4:30 o'clock position on the watch face, so that the annular graph encompasses a section of the clock face representing a stock trading day.

3. The device of claim 1 wherein a symbol representing the quantifiable item of data is displayed in close proximity to the annular graph, and; a quantity representing the lowest value of the quantifiable item of data; a quantity representing the value of the quantifiable item of data at the outset of the predetermined time interval; and a quantity representing the highest value of the quantifiable item of data are presented at their respective positions around the annular graph.

4. A method for displaying variable data comprising: receiving the variable data; and displaying an annular graph representing changes in a quantifiable item of data during a predetermined time interval, wherein the annular graph is positioned around a clock face.

* * * * *